United States Patent [19]

Baxter et al.

[11] 4,086,159

[45] Apr. 25, 1978

[54] SOLVENT EXTRACTION OF AROMATIC HYDROCARBONS WITH ETHYLENE OXIDE POLYOL ADDUCTS

[75] Inventors: Clyde Edward Baxter, Angleton; Arthur Emilio Gurgiolo, Lake Jackson, both of Tex.

[73] Assignee: The Dow Chemical Company, Midland, Mich.

[21] Appl. No.: 722,847

[22] Filed: Sep. 13, 1976

[51] Int. Cl.[2] ..... C10G 21/16

[52] U.S. Cl. ..... 208/333; 260/674 SE

[58] Field of Search ..... 208/334, 333; 260/674 SE, 615 B

[56] References Cited

U.S. PATENT DOCUMENTS

| | | | |
|---|---|---|---|
| 2,411,025 | 11/1946 | Coghlan | 208/334 |
| 2,770,663 | 11/1956 | Grote | 208/334 |
| 2,840,620 | 6/1958 | Gerhold et al. | 260/674 SE |

*Primary Examiner*—Herbert Levine

*Attorney, Agent, or Firm*—Benjamin G. Colley

[57] ABSTRACT

A process for the separation of aromatic hydrocarbon compounds from mixtures thereof with non-aromatic hydrocarbon compounds wherein the mixtures are contacted with an ethoxylated alkane polyol solvent having a number average molecular weight range from about 250 to about 1100 to form an extract containing the aromatics and separating the extract from the non-aromatic compounds.

7 Claims, No Drawings

SOLVENT EXTRACTION OF AROMATIC HYDROCARBONS WITH ETHYLENE OXIDE POLYOL ADDUCTS

BACKGROUND OF THE INVENTION

This invention relates to a solvent extraction process for separating aromatic hydrocarbons from hydrocarbon mixtures which consist of aromatic hydrocarbons admixed with other hydrocarbon species such as paraffins, branched paraffins, cycloparaffins and/or olefins using ethoxylated polyol solvents having a number average molecular weight range from about 250 to about 1100.

It is known that both extraction and distillation techniques have been employed in separating particular hydrocarbon species, e.g., the aromatic hydrocarbons, from petroleum hydrocarbon mixtures having narrow boiling point ranges. For such mixtures, solvent extraction techniques have been employed. These techniques have problems, one of the more significant being the difficulty in choosing a solvent with high capacity for the aromatic hydrocarbon species to be separated as compared with those hydrocarbon species not desired. Most selective solvents particularly those which are selective for aromatic materials will also dissolve significant proportions of non-aromatic hydrocarbon species.

It is desired to treat the petroleum fractions in such a manner as to separate an aromatic rich stream from the saturated and olefinic aliphatic hydrocarbons. The aromatics have very high octane numbers and are useful for blending into motor gasoline. This is of particular value since leaded gasolines are being phased out of use. In addition, such aromatics as benzene, toluene and the zylenes are valuable feedstocks for a wide variety of used in chemical industry. The raffinates can be used as components in jet fuel or heating oils or as feed to catalytic reforming. Thus, over the years, there has been a continuing search for solvents which are selective to aromatic hydrocarbons only and have a high solvent capacity for said aromatic hydrocarbons and, at the same time, dissolve very little, if any, of the non-aromatic hydrocarbon species.

A number of selective solvents have been proposed and described for the extraction of aromatic hydrocarbons from mixtures of aromatic and non-aromatic paraffins, olefinic and naphthenic hydrocarbons. The use of alkylene oxide adducts of phenyl glycidyl ether as selective solvents is disclosed in U.S. Pat. No. 3,379,788. The use of mixed alkylene oxide adducts of ethylene or propylene glycol is disclosed in U.S. Pat. No. 2,834,820. The use of di-ethylene glycol, triethylene glycol and tetraethylene glycol is disclosed in U.S. Pat. Nos. 2,302,383; 2,711,433; 2,803,685; and 3,037,062.

The use of di, tri and tetraethylene glycols as aromatic extracts has attained widespread usage in industry. These diols had a fair balance of properties which permitted the selective extraction of aromatics and rejected the aliphatic hydrocarbons. Nevertheless these compounds did suffer from having low capacity values and so required high solvent to feed ratios. Consequently increased plant sizes and equipment were needed to handle the large volumes of solvents needed.

The solvents of this invention have a higher capacity for aromatics than the diols of the prior art. By replacing the solvents of the prior art with the solvents of this invention in existing plants and at existing flow rates, dramatically increased yields of aromatics can be obtained.

Used in a new plant, the solvents of this invention would require considerably less plant size and equipment for the same amount of solvent as below since about twice as much aromatics can be extracted.

SUMMARY OF THE INVENTION

It has been discovered that aromatic hydrocarbons can be extracted selectively from mixtures of aromatic, olefinic and aliphatic hydrocarbons using ethoxylated triols and tetrols. The invention comprises a process for the separation of aromatic hydrocarbon compounds from mixtures containing both aromatic and non-aromatic compounds which comprises the steps of contacting a mixture containing both aromatic and non-aromatic hydrocarbon compounds with an ethoxylated alkane polyol solvent having at least three ethoxylated hydroxyl groups and a number average molecular weight range from about 250 to about 1100 and preferably in the range from about 400 to about 800 to form an extract containing said solvent and the aromatics wherein said polyol is derived from an alkane polyol having 3-6 carbon atoms and 3-4 hydroxyl groups and separating said extract from the non-aromatic compounds.

These solvents are prepared by making ethoxylated adducts of polyols in a manner known in the art such as shown in U.S. Pat. No. 2,948,757. The polyols used as starting materials can be selected from glycerine, trimethylolethane, trimethylolpropane, 1,2,3-butane triol, diglycerol, pentaerythritol, erythritol, 1,2,4-butane triol, 1,2,6-hexane triol and similar triols and tetrols.

DETAILED DESCRIPTION

Suitable feedstocks for the satisfactory practice of this invention include fluid mixtures having a sufficiently high concentration of aromatic hydrocarbons to economically justify their recovery as a separate product stream. The present invention is particularly applicable to hydrocarbon feed mixtures which contain at least about 25 percent by weight of aromatic hydrocarbons. A suitable carbon number range for the feedstock is from about six carbon atoms per molecule to about 20 carbon atoms per molecule and, preferably, from about six to ten carbon atoms per molecule. Typically, the feedstock will contain single ring hydrocarbons comprising a wide boiling mixture of benzene, toluene and xylenes. These aromatic hydrocarbons are mixed with corresponding paraffins and olefins.

The aromatic hydrocarbons are separated from the mixed hydrocarbon stream by contacting the stream in a conventional liquid-liquid extraction technique with the polyol solvents set forth above.

The extraction of aromatic hydrocarbons from a mixed hydrocarbon stream using these solvents may take place at temperatures from about 70° to about 250° F, preferably at temperatures ranging from about 120° to 180° F. The pressure is not critical and it is, therefore, convenient to use atmospheric pressure. Typically, from 1 to 5 volumes, preferably about 2 to 3 volumes, of solvent are employed per volume of feedstock.

The recovery of aromatics from a mixture with aliphatic hydrocarbons, using the solvents of this invention is advantageous over conventional systems in that the boiling point of the solvent is dramatically higher than any component of the feed stock. Consequently, the solvent plus aromatic extract can be heated quite hot in a still and the aromatics distilled from the solvent. This permits recovery of higher boiling aromatics such as ethylbenzene and poly substituted benzenes. When these components are present, it may also be advantageous to inject a low amount of aliphatic hydrocarbon such as pentane to help sweep the higher boiling aromatics out of the system. The pentane, being low boiling, may then easily be recovered by distillation and recycled.

Alternatively, the solvent-aromatic extract may be treated with pentane, and the aromatics extracted into the pentane layer. This layer is decanted from the solvent and distilled to recover the low boiling pentane for recycle and the aromatics fractionated as usual. The solvent is then recycled.

If much olefinic hydrocarbon is present in the feedstock, it will tend to transfer to the aromatic-solvent layer. On distillation of the aromatics from this extract, the olefins tend to polymerize and build-up in the solvent. Since the solvent cannot be distilled as in the conventional solvents, it must be periodically purified in other ways. One way is to run the contaminated solvent over a charcoal bed which absorbs the polyolefins. Another way is to add water to the contaminated solvent. The solvent dissolves in the water and the polyolefins will separate an an insoluble phase. Water is then distilled from the purified solvent, and the solvent recycled. If desired, for economic reasons, 5% water may be left in the solvent and recycled to the extraction column.

Examples 1–5

A series of glycerine ethylene-oxide triols were prepared by reacting varying amounts of ethylene oxide with glycerine using 0.1% potassium hydroxide as the catalyst at a temperature of 100° C for 8 hours. These compounds are complex mixtures having on each hydroxyl radical one or more ethylene oxide adducts. They are further described in Table I.

TABLE I

GLYCERINE-ETHYLENE OXIDE TRIOLS

| E.O. Triols | Moles EO | Number Average Mol. Wt. (GPC) | % OH |
|---|---|---|---|
| Control 1 | 3 | 190 | 22.6 |
| Example 1 | 6 | 290 | 13.6 |
| Example 2 | 9 | 420 | 9.7 |
| Example 3 | 12 | 590 | 7.5 |
| Example 4 | 15 | 690 | 6.3 |
| Example 5 | 18 | 850 | 5.4 |

GPC - determined by gel permeation chromatography

Aromatic capacity and selectivity values were determined for each solvent of Examples 1–5 by extracting stock solutions of 50% benzene/50% heptane and 50% xylenes/50% heptane with the solvents in a 3:1 solvent-/feet ratio for 1 hour at ambient temperature. The layers were allowed to separate for 1–3 hours and the extract layer was then analyzed by gas chromatography (gc) for percent benzene and percent heptane extracted. A Hewlitt Packard 5700A Gas Chromatography with Hewlitt Packard 3373B Integrator was used for this purpose. Analysis was carried out on a 3feet × ⅛ inch stainless steel thin wall column packed with Porapac Q, 100–120 mesh. The gas chromatogram was run isothermally at 170° C for benzene analysis and 200° C for xylenes analysis with an injection port temperature of 200° C and a detector temperature of 250° C. The solvents do not elute. The results are shown in Table II.

TABLE II

| Examples | | Benzenes Capacity | Benzenes Select. |
|---|---|---|---|
| 1 | | 0.44 | 16.8 |
| 2 | | 0.93 | 32.3 |
| 3 | | 0.69 | 16.0 |
| 4 | | 0.74 | 14.4 |
| 5 | | 0.82 | 16.2 |
| Control 1 | (glycerine plus 3 moles E.O.) | 0.23 | 17.4 |
| Control 2 | (tetraethylene glycol) | 0.32 | 16.3 |
| Control 3 | (triethylene glycol) | 0.30 | 16.3 |
| Control 4 | (diethylene glycol) | 0.33 | 16.4 |

Capacity is defined as a distribution coefficient which is the ratio of the concentration of aromatics in the solvent phase to the concentration of aromatics in the raffinate phase.

Selectivity is defined as the ratio of the distribution coefficient for aromatics divided by the distribution coefficient for non-aromatics.

Capacity increases as the solvent dissolves more aromatics, and selectivity increases as the ability of the solvent to reject aliphatics increases.

Exaination of Table II shows that the capacity of these new aromatic extractants are greatly superior to those of the prior art (Controls 2, 3 and 4) in every instance. Further, as the molecular weight of the new solvents increase, their capacity increases at no expense to selectivity. It would appear that only viscosity increases would limit the range of usefulness of these new extractants. By operating at higher temperatures, viscosity effects could be minimized. It has been found as a matter of practicality that molecular weights as high as 1100 are suitable solvents. The increase in capacity of Example I over the E.O. triol of control 1 is 91%. The increase in capacity of Example 1 over the diol of Control 2 is 37.5%. Capacity is by far the most important parameter in comparison with selectivity since the former determines the amount of circulating solvent required for extraction and subsequently the size of physical plant.

EXAMPLE 6

In the same manner as described for Examples 1–5, one mole of trimethylol propane was reacted with 18 moles of ethylene oxide to make a triol having a number average molecular weight of 926.

Under the extraction conditions set forth above, this compound was found to have a capacity of benzene of 0.51 and a selectivity for benzene of 9.0.

EXAMPLE 7

Following the procedures of Examples 1–5, one mole of 1,2,6-hexane triol was ethoxylated with 18 moles of ethylene oxide to obtain an ethoxylated triol product having a number average molecular weight of 926.

Under the extraction conditions set forth above, this compound was found to have a capacity for benzene of 0.44 and a selectivity for benzene of 8.4.

EXAMPLE 8

Following the procedures of Examples 1–5, one mole of pentaerythritol was reacted with eight moles of ethylene oxide to make an ethoxylated tetrol having a number average molecular weight of 469.

Under the extraction conditions set forth above, this compound was found to have a capacity for benzene of 0.69 and a selectivity for benzene of 11.8.

Following the above examples similar results are obtained by using trimethylolethane, 1,2,3-butane triol, 1,2,4-butane triol, diglycerol and erythritol.

We claim:

1. A process for the separation of aromatic hydrocarbon compounds from mixtures containing both aromatic and non-aromatic hydrocarbon compounds which comprises:

(A) contacting a mixture containing both aromatic and non-aromatic hydrocarbon compounds with an ethoxylated alkane polyol solvent having at least three ethoxylated hydroxyl groups and a number average molecular weight range from about 250 to about 1100 to from an extract contained said solvent and the aromatics wherein said polyol is derived by ethoxylating an alkane polyol having 3-6 carbon atoms and 3-4 hydroxyl groups, and (B) separating said extract from the non-aromatic hydrocarbon compounds.

2. The process as set forth in claim 1 wherein the alkane polyol is selected from the group consisting of glycerine, trimethylol propane, 1,2,3-butane triol, diglycerol, pentaerythritol, erythritol, 1,2,4-butane triol, 1,2,6-hexane triol and trimethylolethane.

3. The process as set forth in claim 1 wherein the molecular weight range is from about 400 to about 800.

4. The process as set forth in claim 2 wherein the alkane polyol is trimethylol propane.

5. The process as set forth in claim 2 wherein the alkane polyol is 1,2,6-hexane triol.

6. The process as set forth in claim 2 wherein the alkane polyol is glycerine.

7. The process as set forth in claim 2 wherein the alkane polyol is pentaerythritol.

* * * * *

UNITED STATES PATENT AND TRADEMARK OFFICE

CERTIFICATE OF CORRECTION

PATENT NO. : 4,086,159

DATED : April 25, 1978

INVENTOR(S) : C. E. Baxter and
A. E. Gurgiolo

It is certified that error appears in the above-identified patent and that said Letters Patent are hereby corrected as shown below:

Col. 1, line 37; "used" second occurrence should be --- uses ---.

Col. 3, line 27; "an an " should be --- as an ---.

Col. 4, line 26; "Exaination" should be --- Examination ---.

Col. 4, line 52; "of benzene" should be --- for benzene ---.

Col. 5, line 19 (Claim 1) should read --- form an extract containing .....---.

Signed and Sealed this

Tenth Day of October 1978

[SEAL]

*Attest:*

RUTH C. MASON
*Attesting Officer*

DONALD W. BANNER
*Commissioner of Patents and Trademarks*